United States Patent [19]

Lewis, Jr. et al.

[11] Patent Number: 5,020,161

[45] Date of Patent: Jun. 4, 1991

[54] WATERPROOF GLOVE FOR PROTECTIVE COVERALLS

[75] Inventors: Milton A. Lewis, Jr., Richmond, Va.; Jeffrey S. Mason, Covington, Ind.; Carson B. Swinford, Danville, Ill.; Timothy R. Wiseman, Sr., Richmond, Va.

[73] Assignee: E. I. DuPont de Nemours and Company, Wilmington, Del.

[21] Appl. No.: 414,485

[22] Filed: Sep. 29, 1989

[51] Int. Cl.[5] ..... A41D 19/00

[52] U.S. Cl. ..... 2/164; 2/159

[58] Field of Search ..... 2/163, 164, 161 R, 167, 2/159, 16, 169

[56] References Cited

U.S. PATENT DOCUMENTS

| | | | |
|---|---|---|---|
| 242,333 | 5/1881 | Kleinschmidt | 2/164 |
| 2,842,771 | 7/1958 | Foti . | |
| 4,004,295 | 1/1977 | Byrnes, Sr. | 2/161 R |
| 4,095,292 | 6/1978 | Klein | 2/161 A |
| 4,122,554 | 10/1978 | Stager | 2/164 |
| 4,197,592 | 4/1980 | Klein | 2/161 A |
| 4,302,851 | 12/1981 | Adair | 2/158 |
| 4,388,733 | 6/1983 | Anstett | 2/161 R |
| 4,430,759 | 2/1984 | Jackrel | 2/159 |
| 4,433,439 | 2/1984 | Sidman et al. | 2/161 R |
| 4,454,611 | 6/1984 | Tschirch et al. | 2/161 R |
| 4,545,841 | 10/1985 | Jackrel | 156/290 |
| 4,662,006 | 5/1987 | Ross, Jr. | 2/158 |
| 4,679,257 | 7/1987 | Town . | |
| 4,741,052 | 5/1988 | Rubin | 2/161 A |
| 4,773,100 | 9/1988 | Kuo | 2/159 |
| 4,847,918 | 7/1989 | Sturm | 2/161 R |

OTHER PUBLICATIONS

U.S. Patent Application Ser. No. 07/366,711 -filed 6/15/89.

*Primary Examiner*—William A. Cuchlinski, Jr.
*Assistant Examiner*—Daniel G. DePumpo

[57] ABSTRACT

In accordance with the invention, there is provided a protective glove for use with protective coveralls of the type having an outer shell fabric of woven aramid fabric covered by a liquid impervious layer and an inner, multilayer thermally insulating liner fabric of at least one layer of low density nonwoven fabric fastened to a woven fabric. The protective glove includes an outer glove fabricated by sewing from the outer shell fabric of the coveralls. A liner glove is provided within the outer glove and is fabricated by sewing from the multilayer liner fabric of the coveralls. The inner and outer gloves are attached together at the cuffs but is otherwise unattached to the outer glove. The protective glove also includes a continuous intermediate glove fabricated from a waterproof breathable expanded polymeric membrane which is provided between the outer glove and the inner glove. The thumbtip and fingertips of the intermediate glove are secured by adhesive to the outside of the thumbtip and the fingertips of the liner glove but is otherwise unattached from the remainder of the liner glove. The intermediate glove is entirely unattached from the outer glove. The cuff of the glove is attachable to sleeves of the coveralls in use.

6 Claims, 3 Drawing Sheets

WATERPROOF GLOVE FOR PROTECTIVE COVERALLS

BACKGROUND OF THE INVENTION

The present invention relates to garments for providing protection to the wearer in a hazardous environment and more particularly relates to a waterproof glove for use with protective coveralls.

Various types of protective coveralls are shown for use in protecting the wearer of the coveralls from hazards including flame, hot and/or corrosive chemicals, molten metals, and the like. One such type of coveralls includes a one-piece suit for the body, arms and legs and a separate, removable headgear is worn together with the one-piece suit. Protective gloves which are capable of providing generally the same protection as the suit are typically worn with the suit.

Some of the coveralls of this type have a laminated construction with a durable, liquid impervious outer shell which is a barrier to the hazards to be encountered and a liner which increases the protection against high temperature conditions and which may also include additional barrier layers. If gloves are fabricated by sewing from the same materials as the suits, the holes formed by stitching, as well as the seams, can allow the penetration of liquids into the suits which can directly cause injury if such liquids are corrosive and/or hot. In addition, the otherwise harmless entry of water into the lining can impair the thermal insulative protection of the liner increasing the risk of burns.

SUMMARY OF THE INVENTION

In accordance with the invention, there is provided a protective glove for use with protective coveralls of the type having an outer shell fabric of woven aramid fabric covered by a liquid impervious layer and an inner multilayer thermally insulating liner fabric of at least one layer of low density nonwoven fabric fastened to a woven fabric. The protective glove includes an outer glove fabricated by sewing from the outer shell fabric of the coveralls and having a cuff, a palm attached to the cuff, and a thumb and four fingers attached to the palm. A liner glove is provided within the outer glove and is fabricated by sewing from the multilayer liner fabric of the coveralls. Like the outer glove, the inner liner has a cuff, a palm attached to the cuff, and a thumb and four fingers attached to the palm. The inner and outer gloves are attached together at the cuffs but the liner glove is unattached to the outer glove at the palm, thumb and fingers.

The protective glove also includes a continuous intermediate glove fabricated from a waterproof breathable expanded polymeric membrane which is provided between the outer glove and the inner glove. The thumbtip and fingertips of the intermediate glove are secured by adhesive to the outside of the thumbtip and the fingertips of the liner glove but is unattached to the palm and the remainder of the thumb and fingers other than the thumbtip and the fingertips of the liner glove. The intermediate glove is also unattached to the palm, thumb and fingers of the outer glove. The glove is attachable to the sleeves of the coveralls in use.

BRIEF DESCRIPTION OF THE DRAWINGS

The invention and its advantages may be understood by reference to the following detailed detailed description when read in conjunction with the accompanying drawings in which.

DETAILED DESCRIPTION

Figure 1:
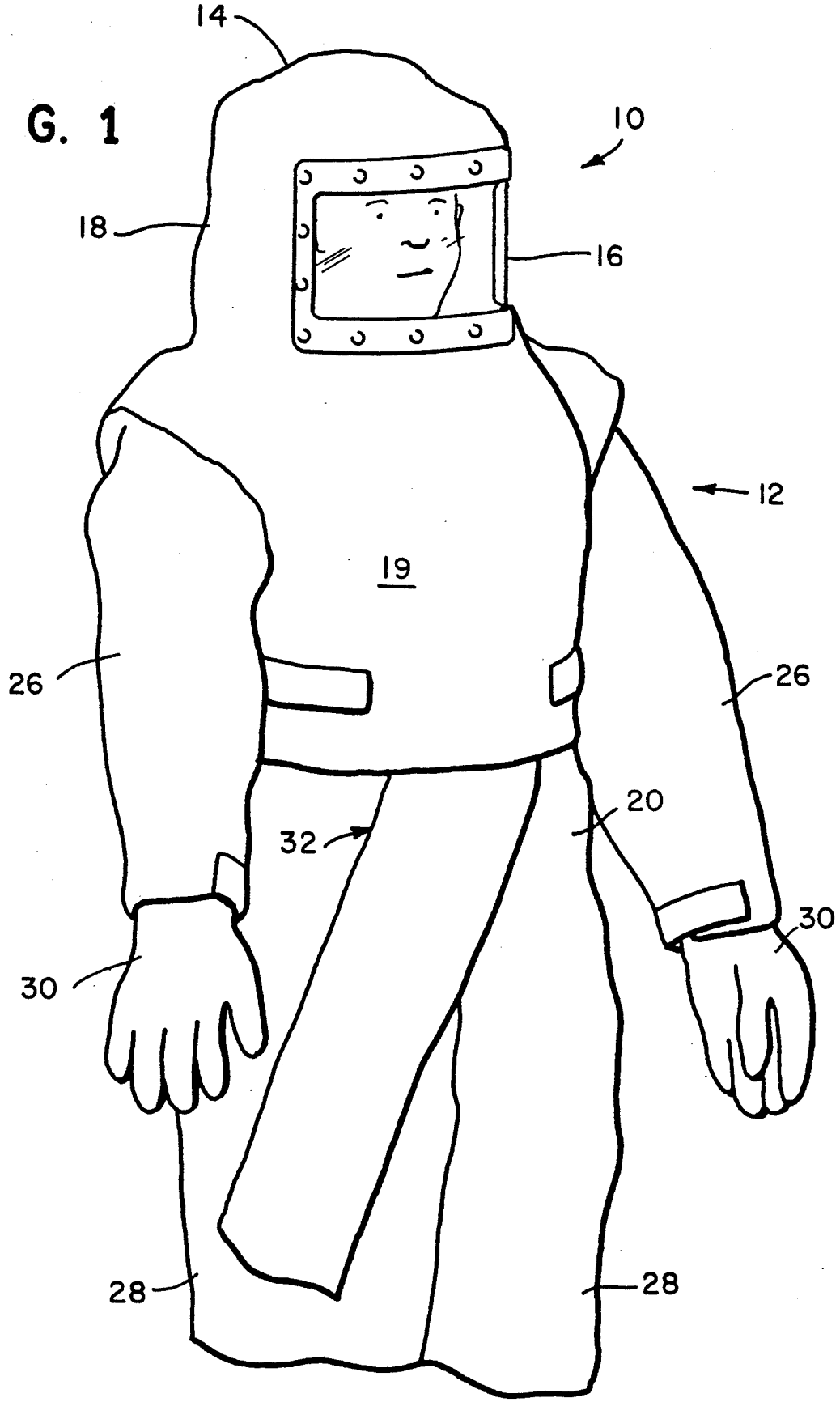
FIG. 1 is a somewhat diagrammatical perspective view of a preferred embodiment of coveralls in accordance with the present invention.

Referring now to the drawings in which like reference characters designate like and corresponding parts throughout the several views, there is shown in FIG. 1 protective coveralls 10 embodying a preferred form of the present invention. The protective coveralls include a one-piece main suit 12 and a removable headgear 14. The headgear 14 includes a viewing lens 16 and a downwardly draping hood 18 for covering the head of the wearer of the coveralls 10 and covering the upper areas of the main suit 12.

The coveralls 10 depicted are intended to represent coveralls which have any of a variety of laminated constructions for protection against hazards including steam, flame, and hot and or corrosive chemicals which include an outer shell fabric of woven aramid fabric covered by a liquid impervious layer and an inner multilayer thermally insulating liner fabric of at least one layer of low density nonwoven fabric fastened to a woven fabric. The inner liner may include other barrier layers. The laminated construction is employed for most portions of the coveralls although the unlined shell may comprise portions of the suit which are not in direct contact with the body such as the hood bib 19. A preferred shell is constructed from a fabric woven from poly(paraphenylene terephthalamide) fiber which has been laminated to a liquid impervious layer, preferably, an aluminum film-poly(ethylene terephthalate) film laminate. A preferred multilayer liner includes at least a layer of woven poly(metaphenylene isophthalamide) and a nonwoven layer such as one or more layers of spun-laced fabrics of poly(paraphenylene terephthalamide).

Referring now to FIG. 1, the main suit 12 includes a torso portion 20 including arm and leg portions 26 and 28, respectively. Gloves 30 are shown attached to the arm portions 26. A main closure 32 is provided in the main suit 12 for providing access into the suit.

Figure 2:
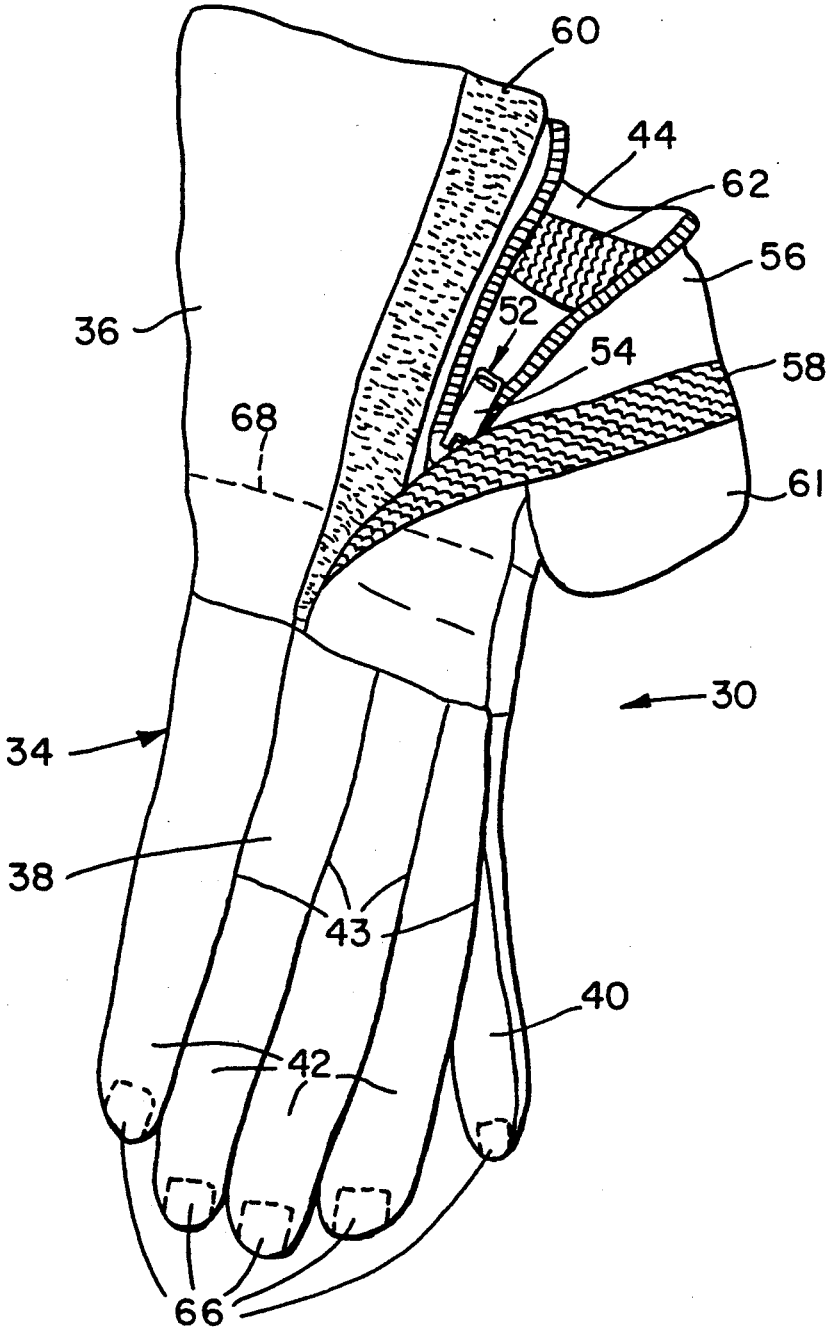
FIG. 2 is an enlarged perspective view of a glove forming a portion of the coveralls illustrated in FIG. 1.
Figure 3:
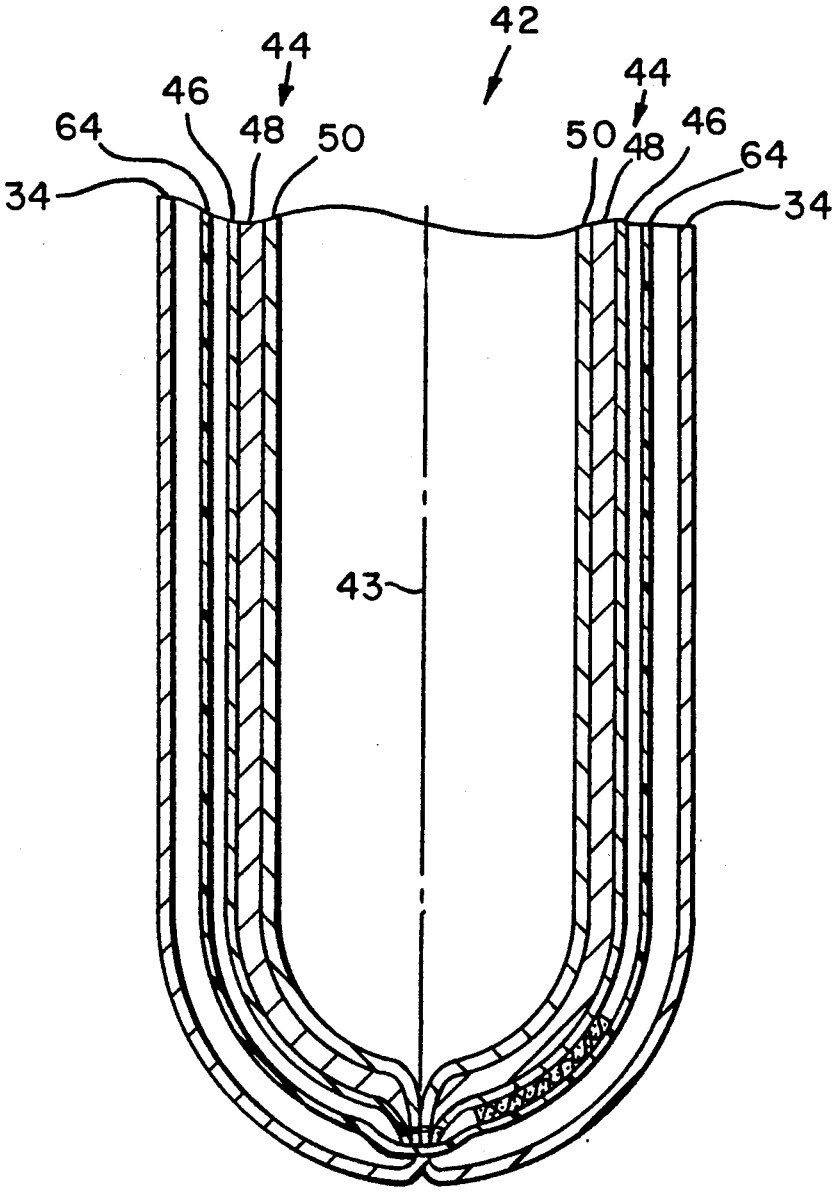
FIG. 3 is a partial cross-sectional view of a finger of the glove illustrated in FIG. 2.

An embodiment of a glove 30 in accordance with the invention is shown in more detail in FIGS. 2 and 3. Like the coveralls 10, glove 30 has a laminated construction including an outer glove 34 fabricated from the same outer shell fabric as the coveralls 10. The outer shell fabric is thus a woven aramid fabric covered by a liquid impervious layer, preferably a fabric woven from poly(-paraphenylene terephthalamide) fiber which has been laminated to a liquid impervious layer, e.g., an aluminum film-poly(ethylene terephthalate) film laminate. As shown generally in FIG. 2, the outer glove 34 includes a cuff 36 and a palm 38 attached to the cuff. As used herein, the word palm 38 is intended to refer to the portion of the glove 30 which covers the palm and encircles the hand and thus also covers the back of the hand. (The part of the palm 38 which covers the back of the hand is shown in FIG. 2.) Attached to the palm 38 are a thumb 40 and four fingers 42. The cuff 36, palm 38, thumb 40, and fingers 42 of the outer shell are provided by sewing together sections of the outer shell fabric which form a number of seams 43 and produce needle holes (not shown) all along the seams.

As is apparent from FIG. 3 showing a finger 42 of the glove in cross-section, the glove of the invention also includes a liner glove 44 fabricated by sewing from the multilayer liner fabric of the coveralls. A portion of the liner glove 44 is visible on the inside of the cuff in FIG. 2 and the liner glove 44 also has palm, thumb, and finger portions which correspond to the palm, thumb and finger portions of the outer glove since the liner glove is suitably dimensioned so that the liner glove 44 fits within the outer glove 34 and serves as a liner for the outer glove.

The laminated construction of the liner glove 44 may be understood by reference to FIG. 3. The preferred liner glove 44 depicted includes a woven aramid fabric outer layer 46 which preferably is a poly(metaphenylene isophthalamide) fabric. Within the outer layer is a thermal insulative layer 48 of low density nonwoven fabric, preferably one or more layers of a spun-laced aramid such as poly(paraphenylene terephthalamide). Within the thermal insulative layer 48, is a woven layer of another woven aramid fabric 50, preferably a poly(-metaphenylene isophthalamide) fabric. The liner layers 46, 48 and 50 are fastened together such as by quilting with the woven inner layer 50 and outer layer 46 providing strength to the typically low strength, low density nonwoven layer. Other barrier layers may be included in the lining glove if desired.

In the embodiment of the glove 30 depicted, the liner glove 44 is attached to the outer glove 34 at their cuffs such as by sewing to produce a lined glove including a lined cuff. A slit 52 is provided in the lined cuff to facilitate putting on and taking off the glove. The slit is closed by a zipper 54 and the zipper is covered by a flap 56. The flap 56 is secured by hook and loop pile fabric tapes 58 and 60, respectively. Suitable fastening tapes of this type tapes are sold under the trademark VELCRO ®. In the preferred embodiment illustrated, a pull tab 61 is provided on the edge of the flap 56 to facilitate disengaging the flap 56 secured over the zipper 54 by the hook and loop pile fastening tapes 58 and 60. The glove 30 is attachable to a main suit 12 by hook and loop pile fabric tapes (only the hook pile tape 62 on the glove is shown).

As shown in FIG. 3, between the outer glove and the liner glove is provided a continuous intermediate glove 64 fabricated from a water-proof breathable expanded polymeric membrane, preferably a water-proof breathable expanded polytetrafluoroethylene membrane such as that sold under the trademark GORE-TEX ® by W. L. Gore and Associates, Newark, Del. Fabricated gloves from the expanded polytetrafluoroethylene membrane are commercially available and are suitable for use in the glove of the invention. The waterproof intermediate glove 64 is attached to the liner glove at the thumbtip and the fingertips by means of adhesive. Preferably, the adhesive is provided by small pieces of two-sided, heat-sensitive adhesive tape 66 covering the thumb and fingertips which facilitates manufacture of the glove 30 as will be described in more detail hereinafter. A suitable location of the heat-sensitive tapes is designated by dotted lines in FIG. 2 and is shown in cross-section in FIG. 3. In FIG. 3, it is shown that it is desirable for the heat-sensitive adhesive tape to be shifted away from seams 43 if the fingertips and thumbtip have seams which provides for more secure attachment. In the preferred embodiment of the glove using the heat-sensitive tapes 66, the outer woven layer 46 provides a secure surface for attachment of the tapes. Other than at the fingertips, the waterproof intermediate glove 64 is unattached to the thumb and fingers and is unattached to the palm of the of the liner glove 44. In addition, the waterproof intermediate glove 64 is entirely unattached to the outer glove 34 and thus is unattached to the palm, thumb, and fingers of the inside of the outer glove 34. The intermediate glove 64 is secured to the liner glove 44 on its cuff at a location above the wrist such as by sewing. A stitch line 68 illustrated in FIG. 2 in dotted lines on the outside of the glove indicates a suitable location for attachment of the intermediate glove to the cuff of the liner glove 44.

A preferred glove 30 in accordance with the invention is easily manufactured by first sewing together the outer glove 34 and its cuff turned inside out and then reversing it. The liner glove 44 with its cuff is similarly sewn together from the multilayer lining fabric but there is no need to reverse it since it is desirable to have the seams away from the wearer's hand in the finished glove. The heat-sensitive tapes are then attached to the ends of the thumbtip and fingertips of the liner glove 44 by sewing. The intermediate glove 64 is then pulled down over the outside of the liner glove 44 with the heat-sensitive tapes on the thumbtip and fingertip and the intermediate glove 64 preferably is secured to the liner glove 44 on its cuff above the wrist by sewing. With the intermediate glove 64 fitted over the liner glove, the liner glove and outer glove 34 can be attached together at the upper area of the cuff with the upper areas of each folded over and toward each other to form a neat hem at the upper edge of the cuff. While the zipper 54 should typically be added to the glove after the liner glove 44 (and intermediate glove 64) is inserted within and is fastened to the outer glove 34, the flap 56, the pull tab 61, and the hook and loop pile tapes 58 and 60 can be added to the outer glove before such assembly. The hook pile tape 62 can similarly be attached to the liner glove 44 before assembly of the outer glove and the liner glove. Another step in the manufacturing is to take the completed or partially-completed glove (at least liner glove 44 with intermediate glove 64 inserted into outer glove 34) and place it on a hand-shaped heat board to make the lining conform to the shell and at the same time activate the heat-sensitive tape 66 to secure the intermediate glove 64 to the liner glove 44 at the thumbtip and fingertips.

The glove in accordance with the invention is used together with the protective suit and provides similar protection that the protective suit provides since it is made of like materials. In addition, the water-proof breathable intermediate layer prevents contact with the wearer by hot and/or corrosive liquids which may leak through the seams and the holes of the outer glove formed by stitching the various portions of the outer glove together. The liner is also prevented from getting wet which can reduce its effectiveness in providing thermal insulation.

Since the material used in the intermediate glove 64 is somewhat delicate, it is prevented from damage during removal of the glove by the wearer since it is attached to the thumbtip and fingertips of the liner glove 44 and thus is not stretched or pulled when the wearer removes the gloves by pulling on the fingertips of the outer glove 34. Moreover, since the intermediate glove 64 is otherwise unattached to the liner glove 44 and the outer glove 34, at the palm and the fingertip portions, there can be relative movement of the outer glove in relation to the inner glove as the wearer works without applying forces to the intermediate glove 64 which could act to stretch or tear it. Thus, the water-proof properties of the glove 30 are preserved during use.

While a preferred embodiment has been shown and described in the foregoing detailed description, it will be understood that the invention is capable of numerous modifications, rearrangements and substitution of parts without departing from the spirit of the invention as set forth in the appended claims.

We claim:

1. In combination with a protective coveralls having torso, sleeve and leg portions, said coveralls having an outer shell fabric of woven aramid fabric covered by a liquid impervious layer and an inner multilayer thermally insulating liner fabric of at least one layer of low density nonwoven fabric fastened to a woven fabric, a protective glove comprising:

an outer glove fabricated by sewing from said outer shell fabric of the coveralls and having a cuff, a palm attached to said cuff, and a thumb and four fingers attached to said palm;

a liner glove fabricated by sewing from said multilayer liner fabric of said coveralls and having a cuff, a palm attached to said cuff, and a thumb and four fingers attached to said palm, said thumb having a thumbtip and said four fingers having four fingertips, said liner glove being provided within said outer glove and said liner and outer gloves being attached together at said cuffs, said liner glove being unattached to said outer glove at said palm, thumb and fingers;

a continuous intermediate glove fabricated from a waterproof breathable expanded polymeric membrane and having a palm, a thumb with a thumbtip and four fingers with fingertips, said intermediate glove being provided between said outer glove and said liner glove and being secured at said thumbtip and said fingertips by adhesive to the outside of the thumbtip and the fingertips of the liner glove, said intermediate glove being unattached to said liner glove at the palm and the remainder of the thumb and fingers other than the thumbtip and the fingertips, and said intermediate glove further being unattached to the palm, thumb and fingers of the outer glove; and means for attaching said protective glove to said sleeve portion of said protective coveralls.

2. The combination of claim 1 wherein said intermediate glove is secured to the liner glove at the finger and thumb tips by heat sensitive tapes.

3. The combination of claim 1 wherein said multilayer liner glove comprises a layer of woven aramid fabric on each side of the low density woven fabric.

4. The combination of claim 1 wherein said intermediate glove is further attached to said liner glove at said cuff.

5. The combination of claim 1 wherein said means for attaching said glove to said sleeve of the coveralls comprises complementary hook and loop pile fastening tapes on said sleeve and on the inside of the cuff of said liner glove.

6. The combination of claim 1 wherein said waterproof glove is a fabricated from an expanded poly(tetrafluoroethylene) waterproof breathable membrane.

* * * * *

UNITED STATES PATENT AND TRADEMARK OFFICE

CERTIFICATE OF CORRECTION

PATENT NO. : 5,020,161

DATED : June 4, 1991

INVENTOR(S) : Milton A. Lewis, Jr., Jeffrey S. Mason; Carson B. Swinford and Timothy R. Wiseman, Sr.

It is certified that error appears in the above-identified patent and that said Letters Patent is hereby corrected as shown below:

On the title page, item [73] Assignee: "E. I. Du Pont de Nemours and Company, Wilmington, Del." should read --E. I. Du Pont de Nemours and Company, Wilmington, Del. and Steel Grip, Inc., Danville, Ill.--.

Signed and Sealed this

Second Day of March, 1993

*Attest:*

STEPHEN G. KUNIN

*Attesting Officer*

*Acting Commissioner of Patents and Trademarks*